US005569339A

United States Patent [19]

Scheuermann

[11] Patent Number: 5,569,339

[45] Date of Patent: Oct. 29, 1996

[54] METHOD OF ANNEALING METAL PARTS

[75] Inventor: Walter Scheuermann, Bonn, Germany

[73] Assignee: LOI Thermprocess GmbH, Germany

[21] Appl. No.: 513,004

[22] Filed: Aug. 9, 1995

[30] Foreign Application Priority Data

Aug. 12, 1990 [DE] Germany ..... 44 28 614.7

[51] Int. Cl.[6] ..... C21D 1/74

[52] U.S. Cl. ..... 148/634

[58] Field of Search ..... 148/634

[56] References Cited

U.S. PATENT DOCUMENTS 3,971,679 7/1976 Burger et al. ..... 148/113

4,167,426 9/1979 Snyder et al. ..... 148/634

*Primary Examiner*—Deborah Yee

*Attorney, Agent, or Firm*—Blakely Sokoloff Taylor & Zafman

[57] ABSTRACT

The present invention relates to a method for annealing metal parts, in particular sheets, in an annealing chamber of an industrial furnace under a protective-gas atmosphere, wherein the annealing comprises a heating phase, a soaking phase and a cooling phase. The annealing chamber is purged during the heating phase with hydrogen or gas rich in hydrogen until the protective gas predominantly contains hydrogen. According to the present invention a purging with an inert gas is performed towards the end of the heating phase to reduce the percentage of hydrogen in the protective gas so that the formation of carbon-containing breakdown products is largely avoided. This prevents the formation of annealing edges during the soaking phase. Towards the end of the soaking phase, a purging with hydrogen or gas rich in hydrogen is performed until the protective gas predominantly contains hydrogen and carbon-containing deposits can be removed.

11 Claims, 1 Drawing Sheet

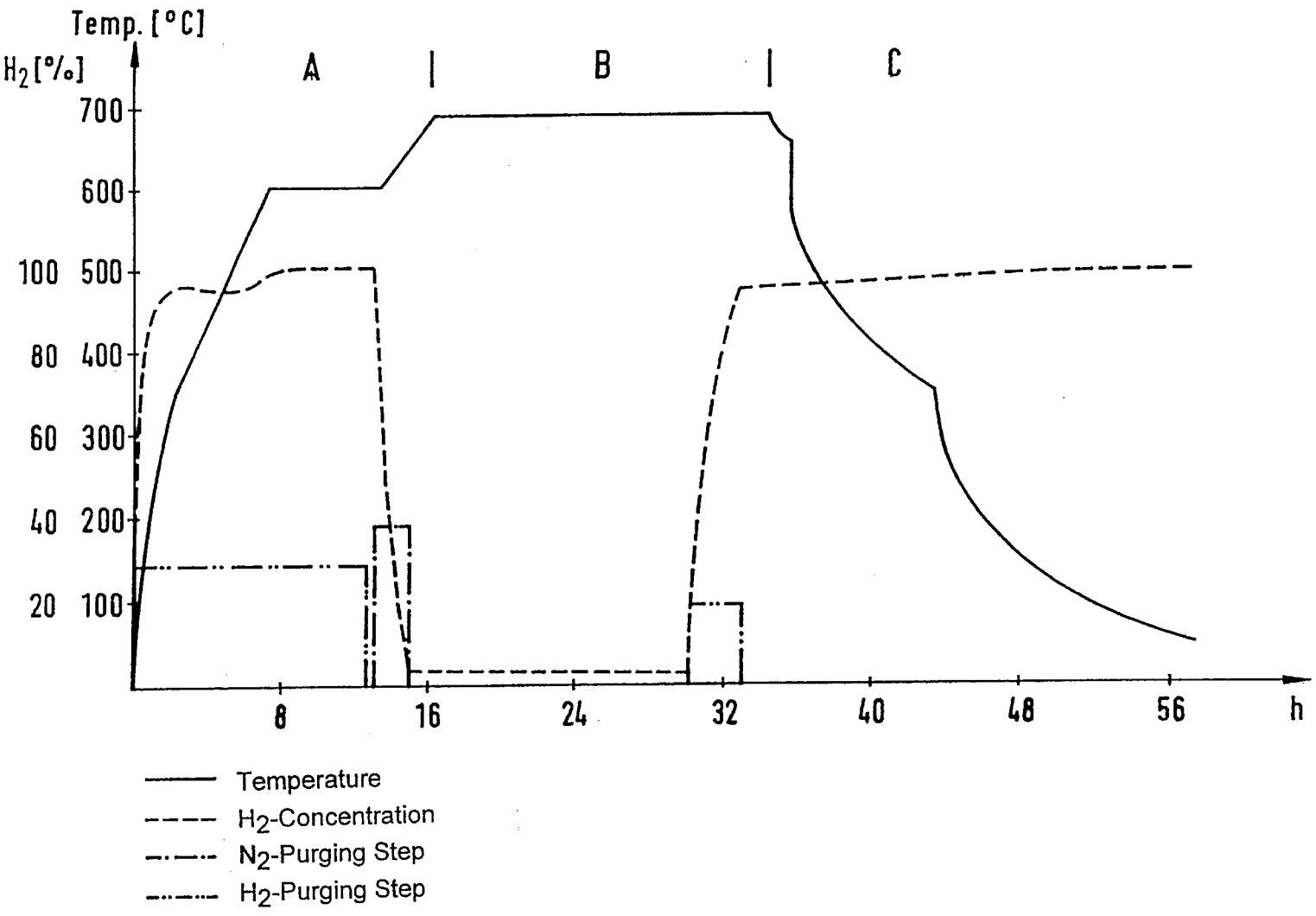
Temp. [°C]
H2 [%]
700
600
500
400
300
200
100
100
80
60
40
20
A
B
C
8
16
24
32
40
48
56
h
Temperature
H2-Concentration
N2-Purging Step
H2-Purging Step

METHOD OF ANNEALING METAL PARTS

BACKGROUND OF THE INVENTION

1. Field of the Invention

The present invention relates to a method for annealing metal parts, in particular sheets, in an annealing chamber of an industrial furnace under a protective-gas atmosphere, wherein the annealing comprises a heating phase, a soaking phase following thereafter and a cooling phase following the two previous phases. The heating of the annealing charge during the heating phase can be according to a pre-set temperature profile over the period of time. The same applies to the cooling of the charge during the cooling phase. During the soaking phase the charge is substantially kept at a constant temperature.

2. Prior Art

Methods of this kind are used particularly for bright annealing cold-rolled steel sheets for the car industry. It is known to use a hydrogen/nitrogen mixture as the protective gas, the hydrogen content of the mixture being greater than the nitrogen content. The mixing ratio is, for example, 75% $H_2$ to 25% $N_2$ and remains constant throughout the entire annealing process. Instead of nitrogen, argon or another inert gas can also be used.

The percentage of hydrogen in the protective gas produces very good heat transfer conditions and also ensures that contaminants are removed from the metal parts. A layer of oil forms during the cold-rolling of sheets which is removed in this manner during bright annealing.

When steels with readily oxidisable alloy elements are annealed, so-called annealing edges of differing widths form at the edges of the steel strips. These annealing edges are formed by oxide layers of the readily oxidisable alloy elements. They make the further treatment of the steel sheets more difficult even if they cannot be seen with the naked eye, as, for example, is the case with aluminium oxide. Furthermore, readily oxidisable alloy elements include not only aluminium and titanium but also above all manganese, silicon and chromium.

THE INVENTION

The object of the present invention is to optimise the annealing process so that the surface quality of the annealed metal parts is improved.

This object is achieved by the method according to the present invention which comprises the following measures:

During the heating phase the annealing chamber is purged in a first purging step with hydrogen or a gas rich in hydrogen until the protective gas predominantly consists of hydrogen;

towards the end of the heating phase the annealing chamber is purged in a second purging step with an inert gas until the percentage of hydrogen in the protective gas is reduced to such an extent that the formation of carbon-containing breakdown products is largely avoided; and towards the end of the soaking phase the annealing chamber is purged in a third purging step with hydrogen or a gas rich in hydrogen until the protective gas predominantly consists of hydrogen.

The second purging step at the end of the heating phase minimises the proportion of reducing hydrogen in the protective gas. The present invention is based on the recognition that the formation of carbon-containing breakdown products, such as CO, $CO_2$ and $CH_4$ is virtually prevented thereby. Thus, the removal of carbon-containing deposits on the sheet surface is substantially slowed down. Surprisingly, it has been found that these carbon-containing deposits protect the readily oxidisable alloy elements and prevent their oxidation during the soaking phase. Therefore, quality-reducing annealing edges no longer occur.

The third purging step then increases the percentage of hydrogen in the protective gas and the removal of carbon-containing deposits recommences. Surprisingly, it has been discovered that this removal during the end phase of the annealing process is sufficient to completely remove the carbon-containing deposits. Thus, not only are annealing edges avoided but very good cleanness of the strip surface is achieved.

Another major advantage is that the consumption of hydrogen is considerably reduced in the method according to the present invention.

The heating phase preferably includes a holding phase at approx. 600° C., the second purging step with the inert gas beginning during the holding phase or at the end thereof.

It is advantageous if the percentage of hydrogen in the protective gas after the second purging step with the inert gas is less than 20%.

When manganese and silicon-containing steels are annealed, the temperature after completion of the second purging step with the inert gas can be 660° to 710° C.

With chromium-containing steels the temperature after completion of the second purging step with the inert gas can be 820° to 860° C.

The percentage of hydrogen in the purging gas after the third purging step towards the end of the soaking phase is advantageously 80 to 100%.

It is particularly advantageous if the third purging step with hydrogen or a gas rich in hydrogen is commenced two to six hours before the end of the soaking phase and if the purging rate is approx. 10 $m^3/h$.

In the cooling phase the contraction of the protective gas is advantageously compensated for with hydrogen or a gas rich in hydrogen.

BRIEF DESCRIPTION OF THE DRAWING

The FIGURE shows in a diagram the hydrogen concentration, the purging steps and the annealing temperature as a function of time.

DETAILED DESCRIPTION OF THE INVENTION

The present invention is described in greater detail in the following with the aid of an example and the attached drawing. The embodiment described is a method for bright annealing cold-rolled steel strips in the form of coils in a bell-type furnace.

Before the furnace is heated, i.e. before the actual annealing process begins, the oxygen is expelled from the annealing chamber of the furnace by purging with a protective gas to avoid the risk of an explosion. The protective gas consists solely of nitrogen.

During a heating phase A purging with hydrogen is performed in a first purging step. The increase in the $H_2$ concentration depends on the purging rate with hydrogen and follows the exponential dilution law until a nearly pure $H_2$ atmosphere is present.

Annealing is performed with this gas up to a temperature of approx. 600° C. At the end of a holding phase lasting several hours at this temperature in which the edge temperature of the coils is still below 600° C., a second purging is performed with nitrogen in a second purging step until the hydrogen concentration has fallen to below 20%. Due to the change in the composition of the protective gas formation of CO, $CO_2$ and $CH_4$ virtually comes to standstill. The removal of carbon deposits from the coil surface is thus slowed down according to the present invention. Annealing edges would start to form as the chamber was heated up to the desired annealing temperature if no purging with nitrogen took place. The oxidisation of readily oxidisable alloy elements, in this case of manganese and silicon, can be reduced to such an extent by the carbon-containing deposits still present that quality-reducing annealing edges no longer occur.

Once the desired annealing temperature of 660° C. has been reached, annealing is continued in a soaking phase B for another 10 hours with a minimum $H_2$ concentration. Approximately 4 hours before completion of the soaking phase B, a third purging step is commenced with pure hydrogen and a purging rate of 10 $m^3/h$ until a $H_2$ concentration of between 80 and 100% is reached. Any carbon-containing deposits still present are now removed.

During a cooling phase C which follows the soaking phase B the contraction of the protective gas is compensated for with pure $H_2$ so that the hydrogen concentration in the protective gas rises slightly again.

With the method described hereinabove not only is the formation of annealing edges considerably reduced but the consumption of hydrogen is also reduced.

I claim:

1. A method for annealing metal parts, in particular sheets, in an annealing chamber of an industrial furnace under a protective-gas atmosphere, wherein the annealing comprises a heating phase, a soaking phase following thereafter and a cooling phase following the two previous phases and wherein the method comprises the following measures:

During the heating phase the annealing chamber is purged in a first purging step with hydrogen or a gas rich in hydrogen until the protective gas predominantly consists of hydrogen;

towards the end of the heating phase the annealing chamber is purged in a second purging step with an inert gas until the percentage of hydrogen in the protective gas is reduced to such an extent that the formation of carbon-containing breakdown products is largely avoided; and towards the end of the soaking phase the annealing chamber is purged in a third purging step with hydrogen or a gas rich in hydrogen until the protective gas predominantly consists of hydrogen.

2. The method according to claim 1 wherein the heating phase includes a holding phase at approx. 600° C. and wherein the second purging step is performed during the holding phase or at the end thereof.

3. The method according to claim 1 or 2 wherein the percentage of hydrogen in the protective gas after the second purging step is less than 20%.

4. The method according to claim 1 wherein the temperature of the soaking phase is 660° to 710° C. during the annealing of manganese or silicon-containing steels.

5. The method according to claim 1 wherein the temperature of the soaking phase is 820° to 860° C. during the annealing of chromium-containing steels.

6. The method according to claim 1, wherein the percentage of hydrogen in the purging gas after the third purging step is 80 to 100%.

7. The method according to claim 1, wherein the third purging step commences 2 to 6 hours before the end of the soaking phase and is performed at a purging rate of approx. 10 $m^3/h$.

8. The method according to claim 1, wherein in the cooling phase the contraction of the protective gas is compensated for with hydrogen or a gas rich in hydrogen.

9. A method for annealing metal pads, in particular sheets, in an annealing chamber of an industrial furnace under a protective-gas atmosphere, wherein the annealing comprises a heating phase, a soaking phase following thereafter and a cooling phase following the two previous phases and wherein the method comprises the following measures:

During the heating phase the annealing chamber is purged in a first purging step with hydrogen or a gas rich in hydrogen until the protective gas predominantly consists of hydrogen;

towards the end of the heating phase the annealing chamber is purged in a second purging step with an inert gas until the percentage of hydrogen in the protective gas is less than 20%; and towards the end of the soaking phase the annealing chamber is purged in a third purging step with hydrogen or a gas rich in hydrogen until the percentage of hydrogen in the protective gas is 80 to 100%.

10. A method according to claim 9, wherein the third purging step is commenced 2 to 6 hours before the end of the soaking phase and is performed at a purging rate of approx. 10 $m^3/h$.

11. A method according to claim 9 or 10, wherein in the cooling phase the contraction of the protective gas is compensated for with hydrogen or a gas rich in hydrogen.

* * * * *

UNITED STATES PATENT AND TRADEMARK OFFICE

CERTIFICATE OF CORRECTION

PATENT NO. : 5,569,339

DATED : October 29, 1996

INVENTOR(S) : Walter Scheuermann

It is certified that error appears in the above-identified patent and that said Letters Patent is hereby corrected as shown below:

On the title page, item [54] and col. 1, line 1, delete "OF" and insert —FOR—

In the title page, column 1, Foreign Application Priority Data section, please delete " Aug. 12, 1990 " and insert -- August 12, 1994 --.

Signed and Sealed this

Eleventh Day of March, 1997

Bruce Lehman

*Attest:*

BRUCE LEHMAN

*Attesting Officer*

*Commissioner of Patents and Trademarks*